US010180226B1

(12) United States Patent
Huang et al.

(10) Patent No.: US 10,180,226 B1
(45) Date of Patent: Jan. 15, 2019

(54) HIGH/LOW BEAM SWITCHING DEVICE AND HEADLAMP COMPRISING THE SAME

(71) Applicants: Hsiang-Yi Huang, Tainan (TW); Hsiu-Ming Huang, Tainan (TW)

(72) Inventors: Hsiang-Yi Huang, Tainan (TW); Hsiu-Ming Huang, Tainan (TW)

( * ) Notice: Subject to any disclaimer, the term of this patent is extended or adjusted under 35 U.S.C. 154(b) by 0 days.

(21) Appl. No.: 15/823,600

(22) Filed: Nov. 28, 2017

(51) Int. Cl.

| | |
|---|---|
| ***F21V 1/00*** | (2006.01) |
| ***F21S 41/692*** | (2018.01) |
| ***F21S 41/43*** | (2018.01) |
| ***F21S 41/141*** | (2018.01) |
| *F21Y 115/10* | (2016.01) |

(52) U.S. Cl.
CPC ..... *F21S 41/692* (2018.01); *F21S 41/141* (2018.01); *F21S 41/43* (2018.01); *F21Y 2115/10* (2016.08)

(58) Field of Classification Search
USPC ..... 362/509
See application file for complete search history.

(56) References Cited

U.S. PATENT DOCUMENTS

2009/0122567 A1* 5/2009 Mochizuki ..... F21V 13/12 362/509

* cited by examiner

*Primary Examiner* — Jamara Franklin

(57) ABSTRACT

A high/low beam switching device generally includes a fixing plate, a solenoid device, a shielding member, and a coil spring. The fixing plate defines an opening which is divided into three zones including an upper space, a middle space, and a lower space. The solenoid device is horizontally disposed in a frame fixed on a shelf extending from the fixing plate. The shielding member, which can cover the middle space of the fixing plate, is pivotally connected to the fixing plate. The solenoid device when being energized can turn the shielding member to uncover the middle space, so that a high beam illumination pattern can be provided. When the solenoid device is de-energized, the shielding member can be turned back to the fixing plate to cover the middle space, so that a low beam illumination pattern can be provided. Also, the present invention provides a headlamp including the switching device.

9 Claims, 6 Drawing Sheets

HIGH/LOW BEAM SWITCHING DEVICE AND HEADLAMP COMPRISING THE SAME

BACKGROUND OF THE INVENTION

1. Field of the Invention

The present invention relates to a high/low beam switching device and a headlamp comprising the switching device.

2. Description of the Prior Art

Generally, a vehicle headlamp is designed to have two types of illumination: high beam illumination and low beam illumination. To enable a headlamp to switch between high beam illumination and low beam illumination, a switching device with a solenoid device may be installed between the base portion and the lens portion of the headlamp. FIG. 1 shows a conventional high/low beam switching device 1, which generally comprises a fixing plate 11, a solenoid device 121, a shielding panel 13, and a T-shaped link member 15. The fixing plate 11, which can be fixed onto a headlamp's base, defines a passage 110 and has two lugs 111. The solenoid device 121 is vertically disposed in a frame 12 fixed onto the fixing plate 11 by means of fasteners 120. Furthermore, the solenoid device 121 is provided with a shaft 122 having a neck portion 123. A coil spring 124 is fitted around the shaft 122. The shielding panel 13 has two arms 130, which can be pivotally connected to the lugs 111 of the fixing plate 11 through a U-shaped retainer 14. The shaft 122 is coupled to the shielding panel 13 through the T-shaped link member 15, wherein two opposite ends of the link member 15 are pivotally connected with the two arms 130 of the shielding panel 13, while the remaining end of the link member 15 defines a slot 150 to be engaged with the neck portion 123 of the shaft 122. Although the switching devie can be used in a headlamp for switching between high beam illumination pattern and low beam illumination pattern, the performance is not good. There is a need for further improvement.

SUMMARY OF THE INVENTION

One object of the present invention is to provide a high/low beam switching device for solving the disadvantage of conventional high/low beam switching devices.

Another object of the present invention is to provide a headlamp for increasing the performance of high/low beam illumination.

The high/low beam switching device generally comprises a fixing plate, a solenoid device, a shielding member, and a coil spring. The fixing plate defines an opening which is divided into three zones including an upper space, a middle space, and a lower space. The solenoid device is horizontally disposed in a frame fixed on a shelf extending from the fixing plate. The solenoid device is provided with a shaft inserted through the lower space of the fixing plate. The shaft is attached at its distal end with a tongue defining a slot. The shielding member is pivotally connected to the fixing plate. The shielding member has two L-shaped arms provided with a pin therebetween. The slot of the tongue can be engaged with the pin provided between the two L-shaped arms of the shielding member, and the coil spring can be fitted around the shaft between the solenoid device and the tongue, so that the shielding member can be urged by the coil spring to cover the middle space. When the solenoid device is energized, the shielding member can be turned away from the middle space, so that a high beam illumination pattern can be provided. When the solenoid device is de-energized, the coil spring can force the shielding member to return to its original position, and thus the middle space can be covered again, so that a low beam illumination pattern can be provided.

Furthermore, the shielding member can be configured with a reflective concave surface to increase the performance of high beam illumination.

The headlamp generally comprises a base, a lens, and a switching device. The base includes a lamp assembly and a reflector, wherein the lamp assembly is provided with an LED unit, and the reflector is mounted over the lamp assembly. The switching device, which is disposed between the base and the lens, generally includes a fixing plate, a shielding member, and a solenoid device. The fixing plate defines an opening which is divided into three zones including an upper space, a middle space, and a lower space. The shielding member is pivotally connected to the fixing plate for covering the middle space of the fixing plate, wherein the shielding member is configured with a reflective concave surface. The solenoid device is mounted to the fixing plate and provided with a shaft inserted through the lower space of the fixing plate to be coupled to the shielding member, so that the shielding member can be rotated by the solenoid device to uncover the middle space. Thus, when the middle space is covered by the shielding member, a front half of the light rays emitting from the LED unit can be reflected by the reflector to pass through the lens without contacting the shielding member, while a rear half of the light rays can be obstructed by the shielding member, thus providing a low beam illumination pattern; when the middle space is uncovered by the shielding member, the front half of the light ray can be reflected by the reflector to pass through the lens without contacting the shielding member, while the rear half of the light rays can be sequentially reflected by the reflector and the reflective concave surface of the shielding member to pass through the lens, thus providing a high beam illumination pattern.

Other objects, advantages, and novel features of the present invention will become more apparent from the following detailed description when taken in conjunction with the accompanying drawings

DETAILED DESCRIPTION OF THE PREFERRED EMBODIMENTS

To show the features and advantages of the present invention, preferred embodiments are provided and illustrated with reference to the accompanying drawings in the following.

Figure 1:
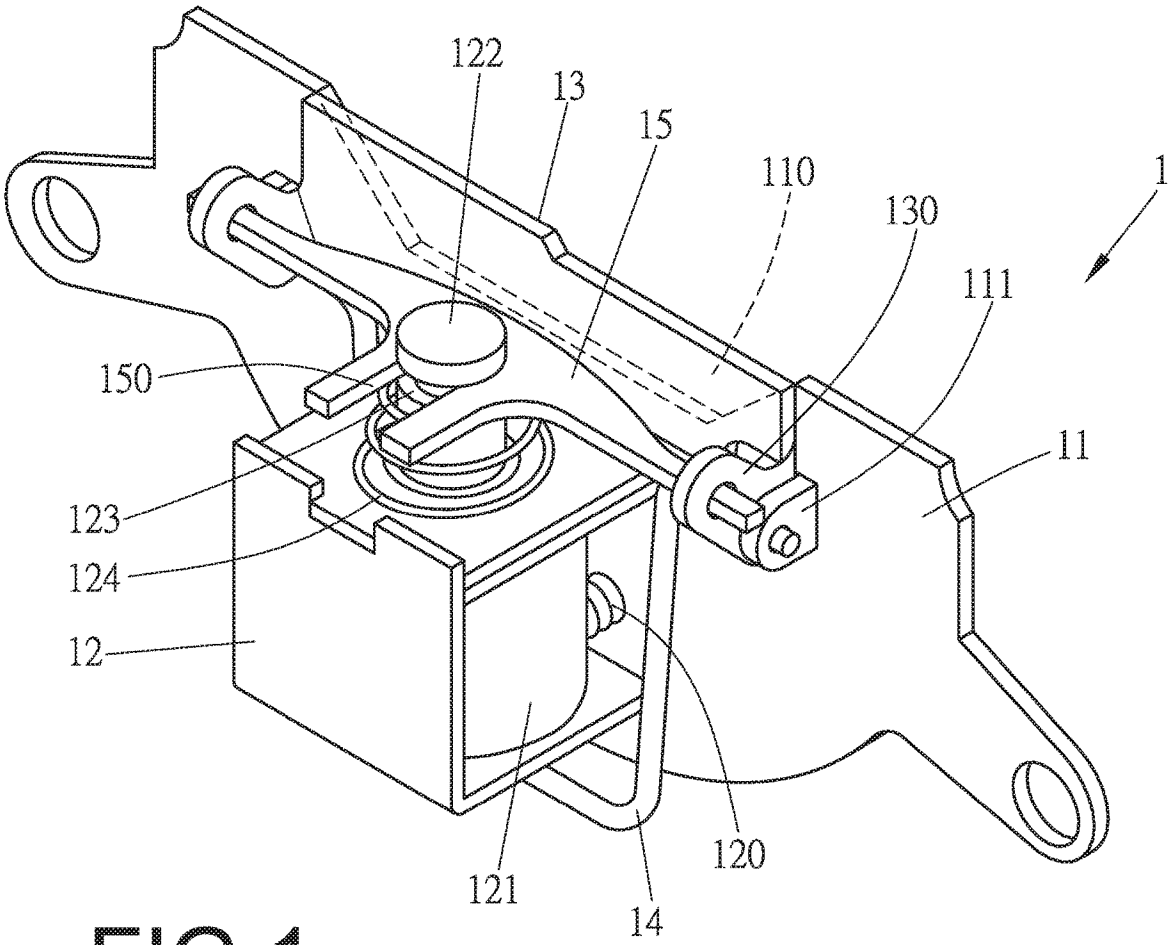
FIG.1 (PRIOR ART)
FIG. 1 shows a 3-dimensional view of a conventional high/low beam switching device.
Figure 2:
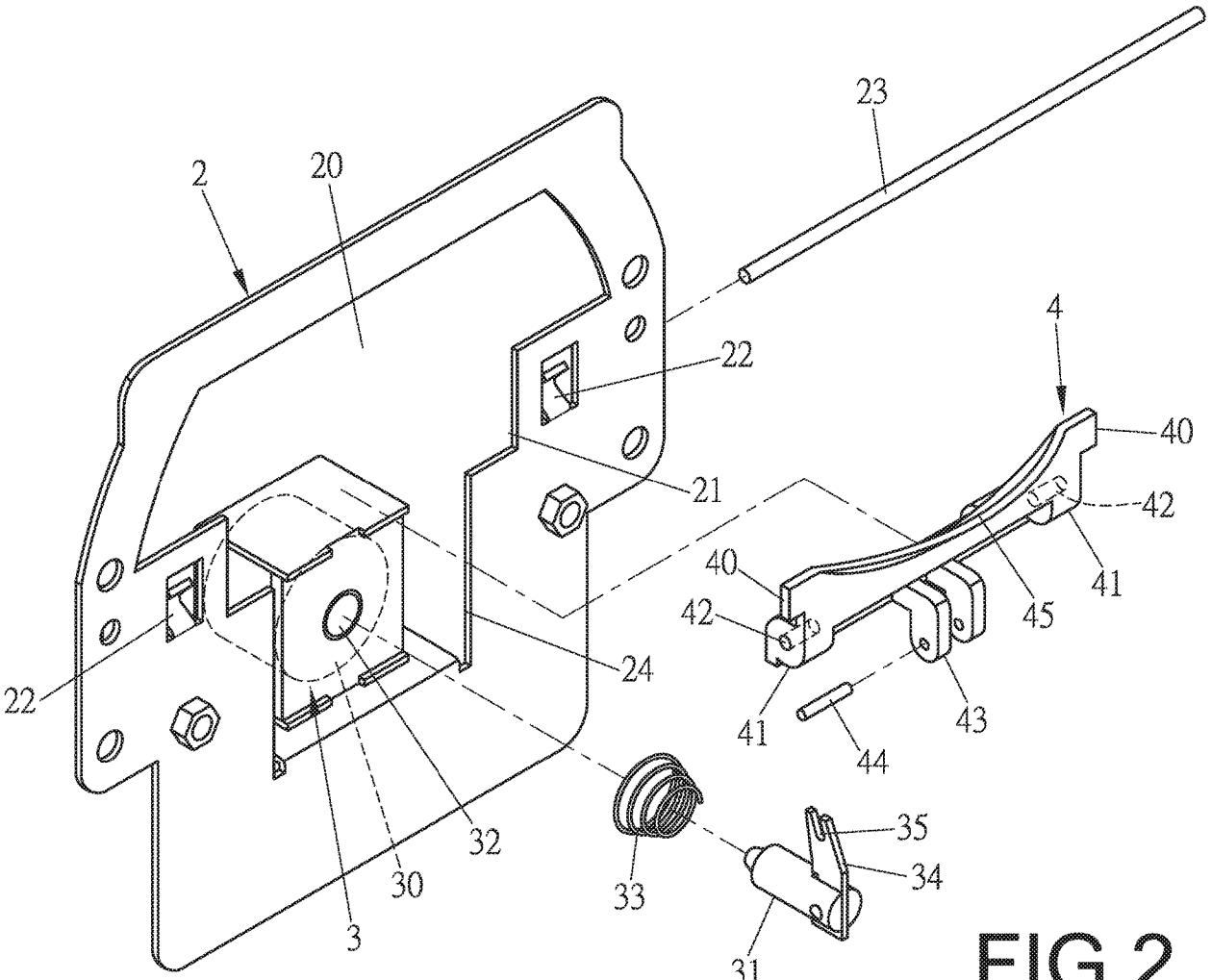
FIG. 2 shows an exploded view of one embodiment of a high/low beam switching device of the present invention.
Figure 3:
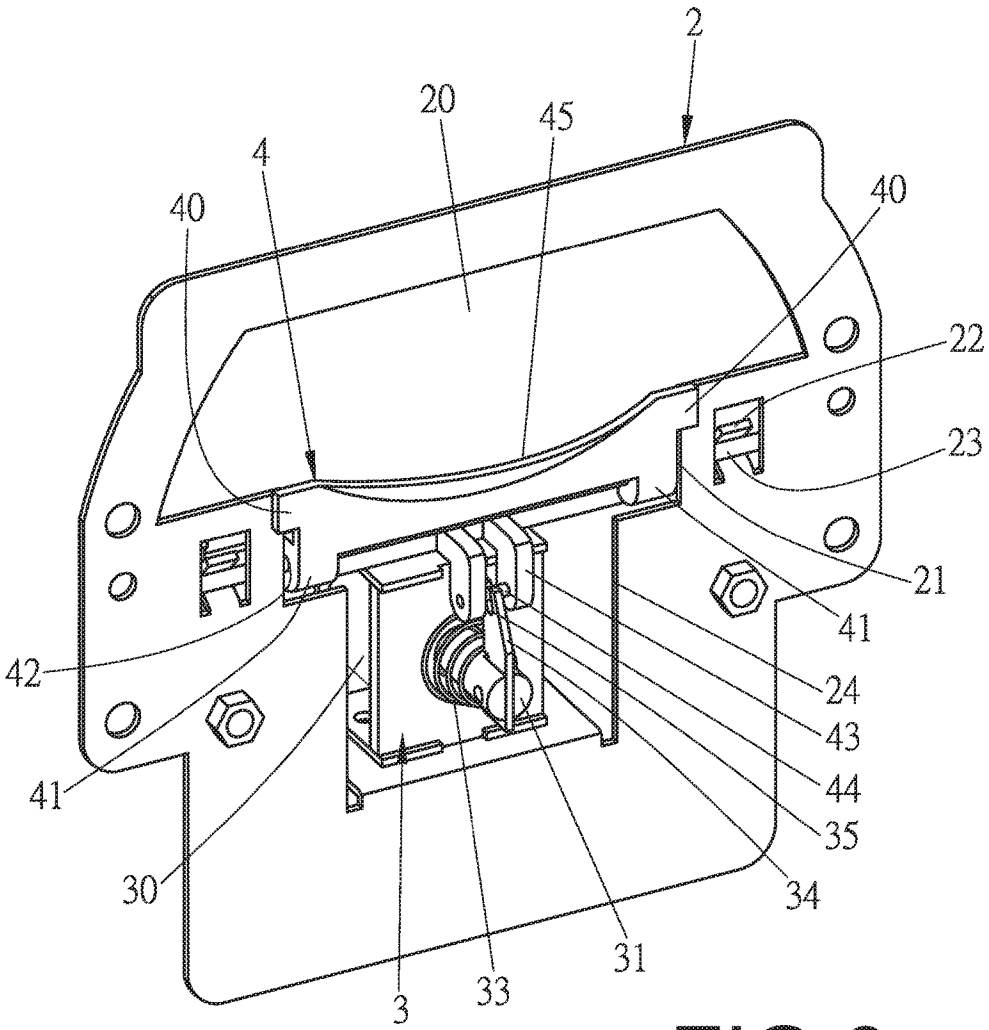
FIG. 3 shows a 3-dimensional view of the embodiment of the switching device.
Figure 4:
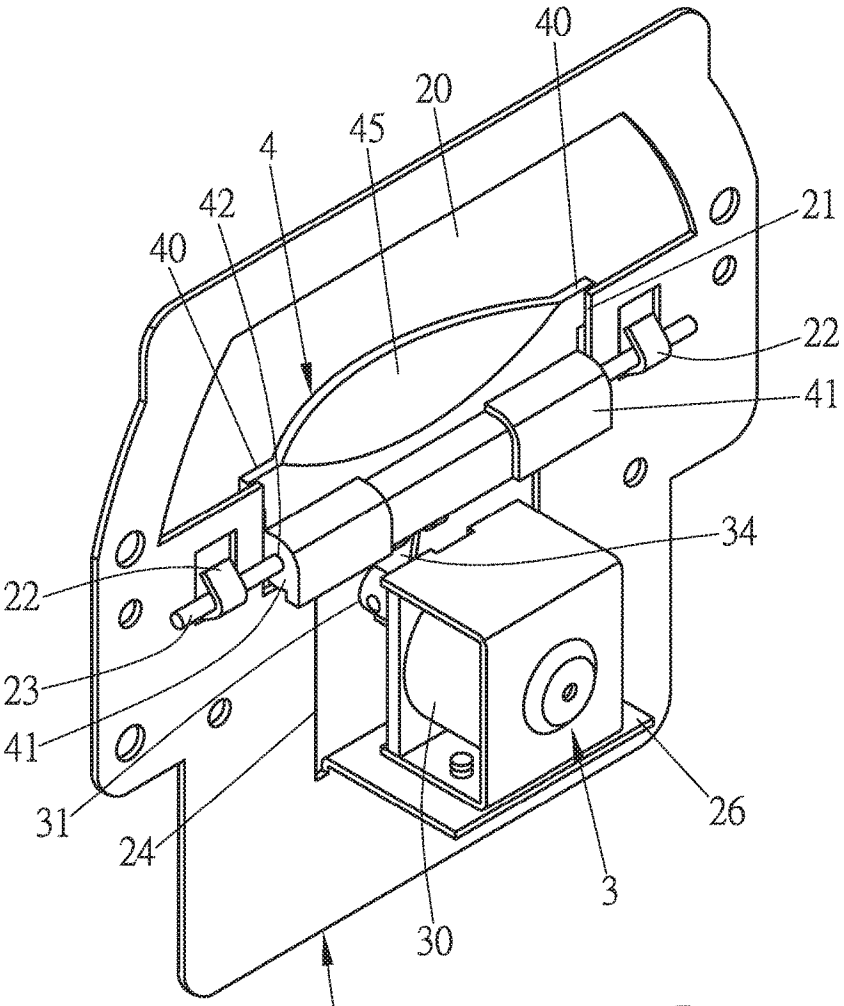
FIG. 4 shows another 3-dimensional view of the embodiment of the switching device.

Referring to FIGS. 2 through 4, one embodiment of a high/low beam swtiching device is shown, which generally comprises a fixing plate 2, a solenoid device 30, and a shielding member 4. The fixing plate 2, which can be made of metal, defines an opening, which is divided into three zones including an upper space 20, a middle space 21 and a lower space 24. The fixing plate 2 is formed at two sides thereof with two curved strips 22, between which the middle space 21 is located, wherein each curved strip 22 defines a recess (not labeled) capable of receiving an elongated rod 23. The two strips 22 can be formed by punch operations. Furthermore, the fixing plate 2 is formed below the lower space 24 with a shelf 26 (see FIG. 4), which extends at a right angle to the plate. The solenoid device 30, which can be mounted on the shelf 26 of the fixing plate 2, is provided with a shaft 31. Preferably, the solenoid device 30 is disposed in a frame 3, which is in turn fixed on the shelf 26 of the fixing plate 2. The shaft 31 is inserted through the lower space 24 of the fixing plate 2. The shaft 31 is attached with a tongue 34 at a distal end thereof. The tongue 34 defines a slot 35. Futhermore, a coil spring 33 can be fitted around the shaft 31 to provide a restoring force for the shielding member 4. The shielding member 4 has a dimension substantally equal to the middle space 21 of the fixing plate 2 for covering the middle space 21. The shielding member 4 defines two pivotal holes 42 at its two ends 41 and has two L-shaped arms 43, between which a pin 44 is provided. Specifically, each L-shaped arm 43 defines a hole (not labeled), into which one end of the pin 44 can be inserted. Furthermore, the shielding member 4 can be formed with two obstructive tabs 40, which respectively extend beyound the two opposite sides of the middle space 21, so that the shielding member 4 can be urged against the fixing plate 2 to cover the middle space 21. Furthermore, the shielding member 4 can be configured with a reflective concave surface 45, which faces the fixing plate 2. The function of the reflective concave surface 45 will be fully illustrated below.

In assembling the components of the switching device, as shown in FIGS. 2 through 4, the coil spring 33 can be fitted around the shaft 31. Then, the shaft 31 can be inserted into the central hole 32 of the solenoid device 30, so that the coil spring 33 is located between the solenoid device 30 and the tongue 34 attached at the distal end of the shaft 31. The tongue 34 can be located between the two L-shaped arms 43 to have the slot 35 engaged with the pin 44 provided between the two arms 43. Next, the two opposite pivotal holes 42 of the shielding member 4 can be arranged to be aligned with the recesses of the curved strips 22, and then the elongated rod 23 can be inserted into the pivotal holes 42 and the recess of the curved strips 22, so that the shielding member 4 can be pivotally connected to the fixing plate 2, wherein the two opposite obstructive tabs 40 can be urged against the fixing plate 2, and thus the shielding member 4 can normally cover the middle space 21 of the fixing plate 2.

Figure 5:
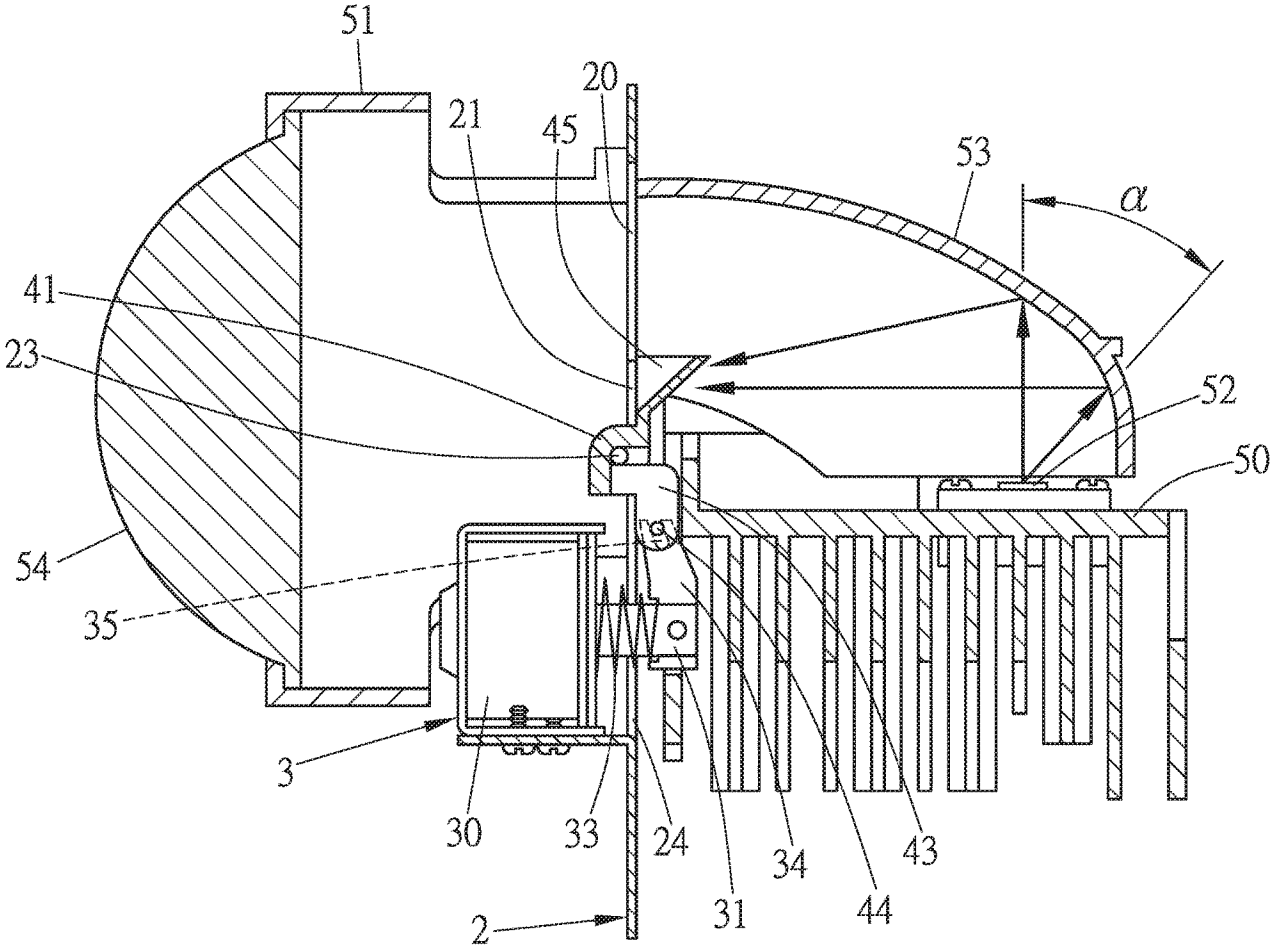
FIG. 5 shows a schematically sectional view of one embodiment of a headlamp including the switching device, wherein the headlamp is at a low beam illumination pattern.
Figure 6:
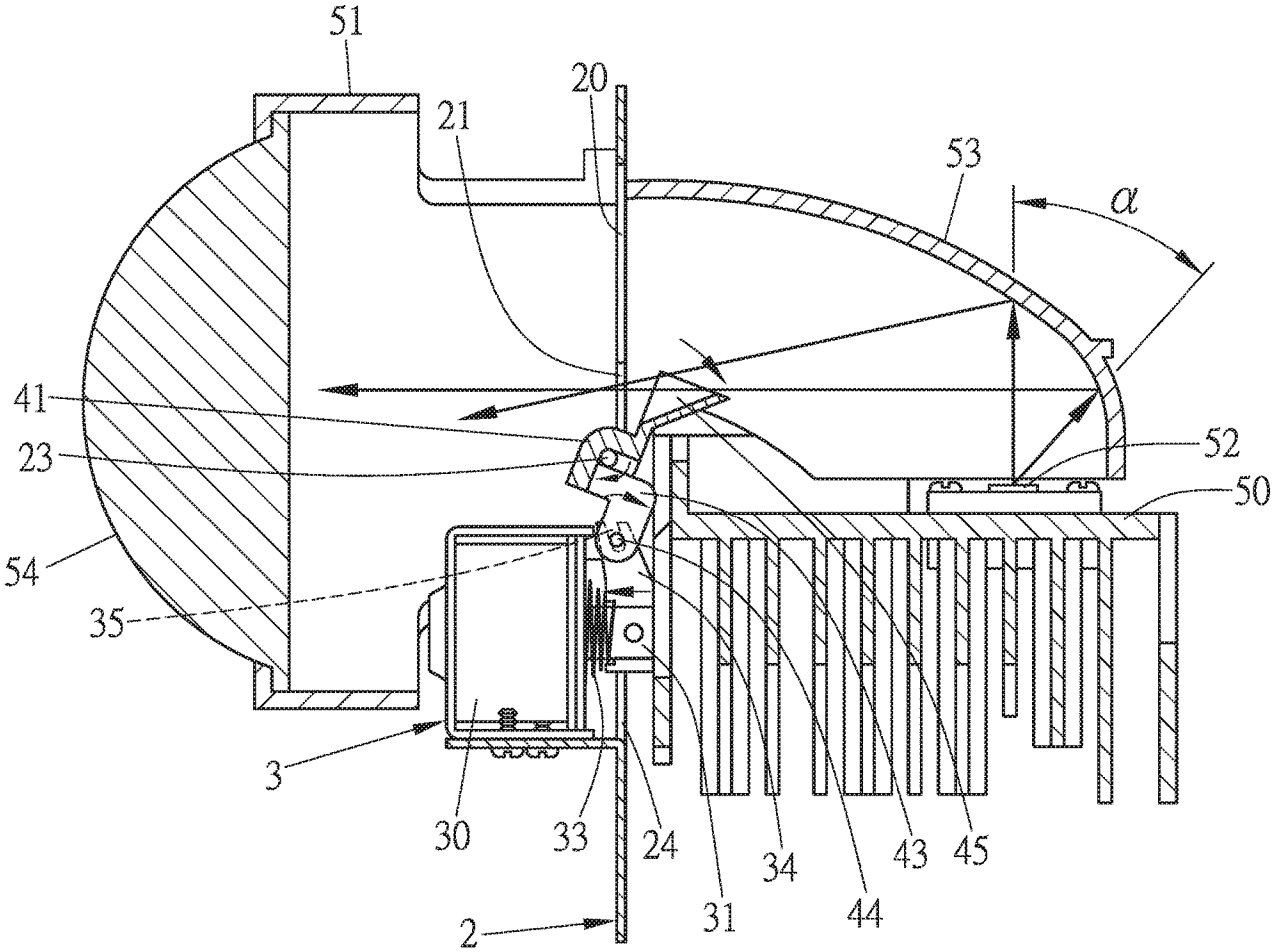
FIG. 6 shows another schematically sectional view of the embodiment of the headlamp, wherein the headlamp is at a high beam illumination pattern.

After completing the assembling process, the assembled device can be installed in a headlamp to provide high beam illumination and low beam illumination. In one embldiment, as shown in FIGS. 5 and 6, the high/low beam switching device can be mounted between a base, including a lamp assembly 50 and a reflector 53, and a lens fixing mount 51, wherein the lamp assembly 50 includes an LED unit 52, and the reflector 53 is located above the lamp assembly 50. The reflective concave surface 45 of the shielding member 4 can work with the reflector 53 to provide a high beam illumination pattern, which includes a central highlight area. Specifically, when the middle space 21 of the fixing plate 2 is uncovered, a rear half of the light rays emitting from the LED unit 52 can be sequentially reflected by the reflector 53 and the reflective concave surface 45 of the shielding member 4 to pass through the lens 54, as shown in FIG. 6, wherein the rear half of the light rays means the portion of light rays within the angle (alpha), which is about one half of the beam angle of the LED unit 52. On the other hand, a front half of the light rays (not shown) emitting from the LED light unit 52 can be reflected by the reflector 53 to pass through the lens 54 without contacting the shielding member 4. As such, a high beam illumination pattern can be formed. When the middle space 21 of the fixing plate 2 is covered by the shielding meber 4, as shown in FIG. 5, the rear half of the light rays can be obstructed by the shielding member 4 and thus cannot pass through the lens 54, while the front half of the light rays (not shown) emitting from the LED unit 52 can be reflected by the reflector 53 to pass through the lens 54 without contacting the shielding member 4. As such, a low beam illumination pattern can be formed.

In operation, as shown in FIG. 6, when the solenoid device 30 is energized, the solenoid device 30 can apply an electro-magnetic force on the shaft 31 to have it moved back towards the solenoid device 30. Consequently, the coil spring 33 can be compressed, and the shielding member 4 can be driven by the tongue 34 to turn away from the middle space 21. Under this circumstance, one portion of the light rays emitting from the LED unit 52 can be incident on the reflective concave surface 45 of the shielding member 4 and reflected to pass through the lens 54, so that a high beam illumination pattern can be provided. When the solenoid device is d-energized, as shown in FIG. 5, since the magnetic force dissappears, the restoring force of the coil spring 33 allows the shaft 31 to move forwardly and thus the shielding member 4 can be turned back to its original position, at which the middle space 21 is covered again. Under this circumstance, only one portion of the light rays emitting from the LED unit 52 can pass throught the lens 54, so that a low beam illumination pattern can be provided. With the high/lower beam switching device of the present invention, the performance of a headlamp can be improved.

While the invention has been described with reference to the preferred embodiments above, it should be recognized that the preferred embodiments are given for the purpose of illustration only and are not intended to limit the scope of the present invention and that various modifications and changes, which will be apparent to those skilled in the relevant art, may be made without departing from the scope of the invention.

What is claimed is:

1. A high/low beam switching device, comprising:

a fixing plate defining an opening which is divided into three zones including an upper space, a middle space, and a lower space, the fixing plate being formed at two sides thereof with two curved strips, between which the middle space is located, each curved strip defining a recess, the fixing plate formed with a shelf below the lower space;

a solenoid device provided with a shaft and mounted on the shelf of the fixing plate, the shaft inserted through the lower space, of the fixing plate and attached at a distal end thereof with a tongue that defines a slot;

a shielding member defining two opposite pivotal holes and formed with two L-shaped arms, between which a pin is provided, for covering the middle space of the fixing plate, the slot of the tongue located between the two L-shaped arms to be engaged with the pin, the two opposite pivotal holes of the shielding member being aligned with the recess of each curved strip to allow an elongated rod to be inserted through the pivotal holes and the recesses of the curved strips, so that the shielding member is pivotally connected to the fixing plate; and a coil spring connected between the solenoid device and the tongue attached at the shaft to provide a restoring force for the shaft;

whereby, when the solenoid device is energized, the shield member is turned away from the fixing plate to uncover the middle space; when the solenoid device is de-energized, the shielding member is turned back to cover the middle space.

2. The high/low beam switching device of claim 1, wherein the shielding member is configured with a reflective concave surface.

3. The high/low beam switching device of claim 2, wherein the solenoid device is located in a frame fixed on the shelf of the fixing plate.

4. The high/low beam switching device of claim 3, wherein the shielding member is formed with two obstructive tabs at two sides thereof to allow the shielding member to be urged against the fixing plate.

5. A headlamp, comprising:

a base including a lamp assembly and a reflector, wherein the lamp assembly has an LED unit, and the reflector is mounted over the lamp assembly;

a lens; and a switching device, disposed between the base and the lens, including:

a fixing plate defining an opening which is divided into three zones including an upper space, a middle space, and a lower space;

a shielding member pivotally connected to the fixing plate for covering the middle space of the fixing plate, the shielding member being configured with a reflective concave surface; and a solenoid device mounted to the fixing plate and provided with a shaft inserted through the lower space of the fixing plate to be coupled with the shielding member, so that the shielding member can be turned away from the fixing plate to uncover the middle space of the fixing plate;

wherein, when the middle space is covered by the shielding member, a front half of the light rays emitting from the LED unit is reflected by the reflector to pass through the lens without contacting the shielding member, while a rear half of the light rays emitting from the LED unit is obstructed by he shielding member, thus providing a low beam illumination pattern; when the middle space is uncovered by shielding member, the front half of the light rays emitting from the LED unit is reflected by the reflector to pass through the lens without contacting the shielding member, while the rear half of the light rays emitting from the LED unit is sequentially reflected by the reflector and the reflective concave surface of the shielding member to pass through the lens, thus providing a high beam illumination pattern.

6. The headlamp of claim 5, wherein the fixing plate is formed at two sides thereof with two curved strips, between which the middle space is located, each curved strip defining a recess; the shielding member defining two opposite pivotal holes alinged with the recess of each curved strip to allow an elongated rod to be inserted through the recesses and the pivotal holes so that the shielding member is pivotally connected to the fixing plate.

7. The headlamp of claim 6, wherein the shaft is attached at a distal end thereof with a tongue that defines a slot; a coil spring is connected between the solenoid device and the tongue to provide a restore force for the shaft of the solenoid device; the shielding member is formed with two L-shaped arms, between which a pin is provided, the slot of the tongue located between the two L-shaped arms to be engaged with the pin; whereby, when the solenoid device is energized, the shielding member is turned away from the fixing plate to uncover the middle space; when the solenoid device is de-energized, the shielding member is turned back to the fixing plate to cover the middle space.

8. The headlamp of claim 7, wherein the fixing plate is formed below the lower space with a shelf for mounting thereon a frame in which the solenoid device is disposed.

9. The headlamp of claim 8, wherein the fixing plate is formed with two obstructive tabs at two sides thereof to allow the shielding member to be urged against the fixing plate.

* * * * *